US008667656B1

(12) United States Patent
Morton

(10) Patent No.: US 8,667,656 B1
(45) Date of Patent: Mar. 11, 2014

(54) SIDE LAP SEAM ATTACHMENT TOOL

(71) Applicant: Nucor Corporation, Charlotte, NC (US)

(72) Inventor: Virgil R. Morton, Yreka, CA (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/857,071

(22) Filed: Apr. 4, 2013

(51) Int. Cl.
*B23Q 11/00* (2006.01)

(52) U.S. Cl.
USPC ..... 29/243.58; 29/243.5; 29/243.56; 72/409.12

(58) Field of Classification Search
USPC ..... 29/243.58, 243.5, 570, 268, 243.56, 29/243, 523, 261, 270, 278; 72/409.12, 72/451, 453.15, 235
See application file for complete search history.

(56) References Cited

U.S. PATENT DOCUMENTS

| | | | | |
|---|---|---|---|---|
| 182,193 | A | 9/1876 | Holeton | |
| 991,440 | A | 5/1911 | Hanna | |
| 1,430,807 | A | 10/1922 | Hoffman | |
| 1,743,209 | A | 1/1930 | Groehn | |
| 2,160,258 | A | 5/1939 | Berliner | |
| 2,254,558 | A | 9/1941 | Williams | |
| 2,620,879 | A | 12/1952 | Fechter | |
| 2,829,714 | A | 4/1958 | Kalb | |
| 2,840,905 | A * | 7/1958 | Geiger | 30/226 |
| 2,874,666 | A * | 2/1959 | Thor | 29/243.5 |
| 3,163,931 | A | 1/1965 | Nielsen | |
| 3,178,806 | A | 4/1965 | Keith | |
| 3,213,583 | A | 10/1965 | Winski | |
| 3,312,028 | A | 4/1967 | Schroyer | |
| 3,411,339 | A | 11/1968 | Brown | |
| 3,473,362 | A | 10/1969 | Black, Jr. et al. | |
| 3,474,585 | A | 10/1969 | Foster | |
| 3,624,876 | A | 12/1971 | Irvin | |
| 3,641,729 | A | 2/1972 | Irvin | |
| 3,685,336 | A | 8/1972 | Black, Jr. | |
| 3,714,688 | A | 2/1973 | Olson | |
| 3,726,000 | A | 4/1973 | Hafner | |

(Continued)

FOREIGN PATENT DOCUMENTS

| | | |
|---|---|---|
| DE | 2418009 | 10/1974 |
| DE | 2423226 | 11/1975 |

OTHER PUBLICATIONS

ICBO Evaluation Report ER-5439, Reissued May 1, 2001, "Attexor Spot Clinch Connection of Cold-Formed Structural Members", ICBO Evaluation Service, Inc., pp. 1-3.

(Continued)

*Primary Examiner* — Lee D Wilson
(74) *Attorney, Agent, or Firm* — Cahill Glazer PLC

(57) ABSTRACT

A punching tool for attaching adjacent steel deck panels along a side-lapped seam positions first and second jaws on one side of the seam, and positions third, fourth and fifth jaws on the other side. An actuator compresses the two sets of jaws; blades on the ends of such jaws shear the seam to create two louvers extending in one direction separated by a third louver extending in the other direction. The first jaw blade passes between the third and fourth jaw blades, and the second jaw blade passes between the fourth and fifth jaw blades. The blades are tapered to prevent binding upon release. The blades may include semi-cylindrical punching portions, and can be formed as detachable inserts coupled to the jaws, as by dove-tail joints. The jaws may be made of a metal having a hardness rating less than that of the detachable blade inserts.

30 Claims, 5 Drawing Sheets

(56) References Cited

U.S. PATENT DOCUMENTS

| | | | | |
|---|---|---|---|---|
| 3,728,779 | A | 4/1973 | Behlen | |
| 3,877,280 | A | 4/1975 | Cornell | |
| 3,877,286 | A | 4/1975 | Fontaine et al. | |
| 3,914,845 | A | 10/1975 | Olsson | |
| 3,924,378 | A | 12/1975 | Hafner | |
| 4,035,901 | A | 7/1977 | Lux | |
| 4,037,512 | A | 7/1977 | Sundberg | |
| 4,072,118 | A | 2/1978 | Schultheiss | |
| 4,078,766 | A | 3/1978 | Saurwein | |
| 4,171,599 | A | 10/1979 | Lipp | |
| 4,186,535 | A | 2/1980 | Morton | |
| 4,307,553 | A | 12/1981 | Puckett | |
| 4,353,240 | A | 10/1982 | Undin et al. | |
| 4,375,161 | A | 3/1983 | Braun et al. | |
| 4,392,295 | A | 7/1983 | Sasai et al. | |
| 4,442,581 | A | 4/1984 | Molnick | |
| 4,459,735 | A | 7/1984 | Sawdon | |
| 4,473,925 | A | 10/1984 | Jansen | |
| 4,531,397 | A | 7/1985 | Pratt | |
| 4,558,584 | A | 12/1985 | Myers | |
| 4,571,975 | A | 2/1986 | Pawloski et al. | |
| 4,671,721 | A | 6/1987 | Pratt et al. | |
| 4,757,609 | A | 7/1988 | Sawdon | |
| 4,821,419 | A | 4/1989 | Lee | |
| 4,893,493 | A | 1/1990 | Jacques et al. | |
| 4,918,898 | A | 4/1990 | McLeod | |
| 4,986,691 | A | 1/1991 | Hafner | |
| 4,989,438 | A | 2/1991 | Simon | |
| 4,998,351 | A | 3/1991 | Hartmeister | |
| 5,012,666 | A | 5/1991 | Chen et al. | |
| 5,022,253 | A | 6/1991 | Parlatore | |
| 5,165,213 | A | 11/1992 | Finch et al. | |
| 5,177,861 | A | 1/1993 | Sawdon | |
| 5,208,973 | A | 5/1993 | Sawdon | |
| 5,221,183 | A | 6/1993 | Hoeffken | |
| 5,312,218 | A | 5/1994 | Pratt et al. | |
| 5,381,686 | A | 1/1995 | Thorup | |
| 5,431,089 | A | 7/1995 | Sawdon | |
| 5,435,049 | A | 7/1995 | Sawdon | |
| 5,479,687 | A | 1/1996 | Sawdon | |
| 5,509,291 | A | 4/1996 | Nilsson | |
| 5,727,302 | A | 3/1998 | Sawdon | |
| 5,737,819 | A | 4/1998 | Sawdon | |
| 5,860,265 | A | 1/1999 | Knudson et al. | |
| 5,878,617 | A | 3/1999 | Parker | |
| 5,927,028 | A | 7/1999 | Rossi | |
| 5,984,563 | A | 11/1999 | Wu | |
| 6,070,449 | A | 6/2000 | Vachon | |
| 6,092,270 | A | 7/2000 | Sawdon | |
| 6,115,898 | A | 9/2000 | Sawdon | |
| 6,212,932 | B1 * | 4/2001 | Parker | 72/409.12 |
| 6,240,614 | B1 | 6/2001 | Kojima et al. | |
| 6,308,402 | B1 | 10/2001 | Ellis | |
| 6,397,469 | B2 * | 6/2002 | Parker | 29/897.3 |
| 6,760,962 | B2 | 7/2004 | Seamons | |
| 6,938,452 | B2 | 9/2005 | Rudolph et al. | |
| 6,990,781 | B2 | 1/2006 | Sundstrom | |
| 7,021,108 | B2 | 4/2006 | Bodwell | |
| 7,434,314 | B2 * | 10/2008 | Morton | 29/897.31 |
| 7,484,397 | B2 | 2/2009 | Coelho et al. | |
| 7,845,132 | B2 | 12/2010 | Morton | |
| 8,104,156 | B2 * | 1/2012 | Morton | 29/243.58 |
| 2001/0039704 | A1 | 11/2001 | Parker | |
| 2009/0044392 | A1 * | 2/2009 | Morton | 29/243.5 |

OTHER PUBLICATIONS

ICBO Evaluation Report ER-2078P (Excerpt), Reissued Dec. 1, 2002, "Verco Steel Decks", ICBO Evaluation Service, Inc., pp. 1-8, The Delta Grip System, ASC Steel Deck, Aug. 2002.

* cited by examiner

SIDE LAP SEAM ATTACHMENT TOOL

BACKGROUND OF THE INVENTION

1. Field of the Invention

The present invention relates generally to shear resistant steel decking, and more particularly, to an apparatus for forming a shear-resistant side lap seam attachment in steel decking.

2. Description of the Relevant Art

It is common in the construction of commercial buildings to create floors and roofs from steel deck panels. Such steel deck panels might include ribbed, or "fluted", steel deck panels as well as cellular steel deck panels. Examples of fluted steel deck panels are shown, for example, in U.S. Pat. Nos. 4,186,535 and 4,894,967. Such steel deck panels are typically welded to underlying structural support beams, although mechanical fasteners, such as power-actuated pins or screws may also be used. When properly assembled, such fluted steel deck panels provide a cost-effective diaphragm for forming floors and roofs of commercial buildings. These steel deck panels are often referred to in the trade by the names A-deck, B-deck, F-deck, N-deck, W-deck, etc. Such panels are often provided in different thicknesses, or gauges, ranging from relatively thin 22 gauge stock to more rigid 16 gauge stock. Panel widths are typically 24 inches to 36 inches, depending upon the type of steel deck being used. Individual panel lengths can vary from as little as three feet to over 40 feet. Reinforcing ribs, or "flutes", are formed in such panels. One edge of each such panel, extending parallel to such ribs, includes an upwardly-extending lip. The opposite edge of the panel includes a downwardly-extending inverted U-shaped lip for extending over, and receiving, the upwardly-extending lip of an adjacent panel to form a seam. The two adjacent panels are attached along such seam. Various methods have been used to form the seam attachment, including button punching, crimping, screwing, riveting, welding, as well as shearing and deformation of the deck seam.

Building codes of many geographic areas require buildings to be able to withstand lateral shear forces of specified minimums. This is particularly true for regions known to be subject to high winds (e.g., the Eastern United States), earthquakes or other seismic activity (e.g., the Western United States). Steel roof decks, when properly secured to the underlying building frame, form a diaphragm. In order for the diaphragm to resist lateral shear forces without failure, the seam attachment securing the sides of adjacent panels to each other must be able to effectively resist relative sliding movement of adjacent panels along the seam joining the two panels. Often, side-lapped joints of a steel deck diaphragm must be inspected for consistency and integrity before further construction of a building may proceed. To avoid construction delays, such side-lapped joints should be formed in a manner that allows such joints to be inspected quickly and easily, preferably from the top side of the decking.

Each different seam attachment method presents benefits and disadvantages. For example, button punch tools for deforming "buttons" within the overlapped lips of adjacent panels along the side seam are relatively easy to use, and a number of such attachments can be formed in relatively little time. One such pneumatically-assisted tool for crimping and dimpling the side seam of steel decking is disclosed in U.S. Pat. No. 5,878,617 to Parker. However, such button punches do not form a very secure connection, and are not very effective at resisting lateral shear forces.

Other seam attachment tools actually shear and deform portions of the seam. For example, in U.S. Pat. No. 182,193 issued in 1876, Holeton discloses a method of forming triangular notches in the side-lapped joint and then folding over such triangular notches to interlock the joint. In U.S. Pat. No. 3,641,729, inventor Irvin discloses the use of lip-clenching dies operated by a clinching tool to cut a slit through the side-lapped joint, and to form opposing lobes for securing the side-lapped joint.

U.S. Pat. No. 6,212,932 to Parker discloses a pneumatic shear for forming structural louvers. In one embodiment, a pneumatically-operated tool selectively opens and closes a pair of jaws that are pivotally connected to each other about a common pivot axis. One such jaw includes a single blade having first and second opposing sides forming first and second blunt edges. The second jaw includes two spaced blades that are spaced from each other by the thickness of the single blade on the first jaw, also having blunt edges. Thus, the two spaced blades on the second jaw form a "die" for receiving the single blade on the first jaw when the first and second jaws are pivoted to their closed position. With the jaws in their opened position, the first and second jaws are inserted over a side-lapped seam of a steel deck. The pneumatic tool is then activated to close the jaws toward each other. The single blade of the first jaw passes between the two "die" blades of the second jaw, forming a pair of cuts in the overlapped seam. Further closing of the jaws deforms a central tab in a first direction, while deforming regions on either side of the central tab in the opposite direction. Side-lapped joints formed by use of this apparatus have been shown to securely fasten the side-lapped seams and to satisfactorily resist deformation due to horizontal shear loading.

In U.S. Pat. No. 7,434,314, issued to Morton, a further tool for reliably fastening together side-lapped edges of adjacent deck panels is disclosed. The '314 patent describes a seam attachment tool that includes four jaws, two of which are positioned on one side of the seam, and the other two of which are positioned on the opposite side of the seam. Two of the opposing jaws cooperate with each other to shear a first cut line through the seam. The other two opposing jaws cooperate with each other to shear a second cut line through seam parallel to, and slightly spaced apart from, the first cut line. The material bounded between the first and second cut lines forms a louver or tab. This material is deformed in a first direction adjacent the first cut line, and deformed in the opposite direction adjacent the second cut line. It has been found that prototypes of the seam attachment tool disclosed in the '314 Morton patent form a relatively secure seam attachment, and attain significantly higher shear resistance values than other known punching tools.

Applicant has more recently come to realize that the four-jaw punch tool disclosed in the '314 patent could be further improved. For example, the aforementioned four-jaw tool is not perfectly symmetrical. As a result, when a deck installer triggers the pneumatic actuator on a working prototype of such tool, a torque, or twisting motion, is applied to the handle of the tool, which the operator must resist. Since the deck installer typically makes many of such attachments continuously along the deck seam on a roof, the hands, wrists, and arms of the deck installer can tire easily. In addition, it was found that, when using the working prototype, the jaws of the four-jaw tool would sometimes bind in the deck seam, even after pneumatic pressure was released from the actuator of the tool. This binding of the jaws may be due to the torque exerted upon the seam by the jaws in a non-symmetrical fashion.

One of the stated objects of the invention set forth in the specification of the '314 patent is to provide a punching tool having a blade assembly that equalizes the wear on the blades, and which avoids excessive stress on any particular blade, to extend the usable life of the tool. Applicant has found that, in regard to the aforementioned working prototype, though the addition of the fourth jaw lessened the likelihood of jaw failure, it did not eliminate the problem of jaw failure. When one or more of the jaws fail, the punching tool must essentially be disassembled; the jaw with the broken blade must be detached from the actuator and replaced with a new jaw having a fresh blade. Apart from the need to keep the rather bulky replacement jaws on hand for such instances, significant time is required to disassemble the tool and repair it. During such down time, work on attaching the deck seam necessarily halts. Jaw failure can be reduced somewhat by using a harder steel to form the jaw; however, making the entire jaw from specially hardened steel significantly increases the cost of the tool; it also makes the entire jaw assembly more brittle, which allows for failures in the jaw at points other than the working blade end.

Accordingly, it is an object of the present invention to provide a punching tool for forming an attachment in an interlocking side-lapped seam of a steel deck structure which provides a solid attachment capable of resisting significant horizontal shear loads.

It is a further object of the present invention to provide such a punching tool which can be operated relatively quickly and easily by a deck installer to attach interlocking side-lapped seams of a steel deck structure.

It is a still further object of the present invention to provide such a punching tool which produces an attachment that can be quickly and easily inspected by an inspector standing atop the assembled steel decking.

Another object of the present invention is to provide such a punching tool having jaws that generally equalize the wear on the blades of such jaws, and which avoids excessive stress on any particular blade, to extend the usable life of the tool.

A yet further object of the present invention is to provide such a punching tool which can be repaired quickly and easily if a blade formed on the working end of the jaw should break.

Still another object of the present invention is to form a side-lapped seam attachment that provides higher shear values by forming an attachment which is more resistant to slippage when subjected to a horizontal load along the longitudinal axis of the side-lapped seam.

A still further object of the present invention is to provide such a punching tool which is less likely to bind in the deck seam following actuation of the tool and subsequent release of compressive forces upon the jaws of the tool, to facilitate easier disengagement of the tool from the deck when air pressure on the tool is released.

Yet another object of the present invention is to provide such a punching tool wherein the jaw assembly is symmetrical in nature, and wherein there is no twisting torque force exerted upon the tool handle as the punch tool is actuated.

These and other objects of the invention will become more apparent to those skilled in the art as the description of the present invention proceeds.

SUMMARY OF THE INVENTION

Briefly described, and in accordance with a preferred embodiment thereof, the present invention relates to a punching tool for forming an attachment in an interlocking side-lapped seam of a steel deck structure. The steel deck structure includes at least first and second steel deck panels, each such deck panel including an upturned lip along one side edge thereof, and a downwardly-directed U-shaped channel along the opposing side edge thereof. Adjacent deck panels are arranged so that the downwardly-directed U-shaped channel along a side edge of one panel is inserted over the upturned lip extending from the side edge of the adjacent deck panel.

In one preferred embodiment, the punching tool includes first and second jaws spaced apart from each other, and each having a seam-engaging blade for engaging a first wall of the seam. The tool further includes third, fourth and fifth jaws spaced apart from each other, and each having a seam-engaging blade for engaging the opposing second wall of the seam. Each of the jaws provides a cutting blade on the working end thereof for engaging the seam to be attached. An actuator, which may be pneumatically powered, selectively moves the first and second jaws either toward the third, fourth and fifth jaws to a closed position, or away from the third, fourth and fifth jaws to an opened position. As the first jaw moves from the opened position to the closed position, the seam-engaging blade of the first jaw passes at least partially between the seam-engaging blades of the third and fourth jaws. Similarly, as the second jaw moves from the opened position to the closed position, the seam-engaging blade of the second jaw passes at least partially between the seam-engaging blades of the fourth and fifth jaws.

The seam engaging blades of the third and fourth jaws are spaced apart from each other by approximately the width of the seam-engaging blade of the first jaw. In this manner, the third and fourth jaws collectively form a die for receiving the seam-engaging blade of the first jaw. Likewise, the seam engaging blades of the fourth and fifth jaws are spaced apart from each other by approximately the width of the seam-engaging blade of the second jaw. In this manner, the fourth and fifth jaws collectively form a die for receiving the seam-engaging blade of the second jaw. Finally, it should also be noted that the first and second jaws likewise form a die for receiving the seam-engaging blade of the fourth jaw. The result is that three bowed louvers are formed simultaneously side-by-side within the deck seam each time the punching tool is actuated; the center-most louver is bowed outward in a first direction, and the two surrounding louvers are bowed outward in the opposite direction. This seam attachment is highly resistant to horizontal shear forces applied along the longitudinal axis of the deck seam.

Preferably, a taper is provided on each of the above-described seam-engaging blades to aid in the release of such blades from the deck seam when the actuator of the punching tool is released. In this regard, the seam-engaging blade of the first jaw preferably includes a base region as well as a peak region that projects beyond the base region. Likewise, the seam-engaging blade of the second jaw preferably includes a base region as well as a peak region that projects beyond the base region. Ideally, the width of the peak regions of such blades is slightly less than the width of the base regions of such blades to facilitate the release of the seam engaging blades of the first and second jaws from the side-lapped seam of the steel deck structure. Stated another way, the spacing between the peak regions of the first and second jaws is slightly greater than the spacing between the base regions of the first and second jaws.

In another preferred embodiment of the invention, the punching tool includes detachable blade inserts that allow broken blades to be repaired quickly, and without disassembly of the punching tool. The detachable blade inserts are removably coupled to the working ends of the jaws, preferably by a dovetail joint. Preferably, the jaws of the tool are pivotally mounted about a jaw pivot axle, and each such dovetail joint extends along an axis that is oriented generally perpendicular to the jaw pivot axle. Providing detachable blade inserts allows for the jaws to be made of a relatively elastic type of steel or other metal having a first hardness rating on the Rockwell C scale, while allowing the detachable blade inserts to be made of a metal having a higher hardness rating on the Rockwell C scale to better shear the deck seam.

In the preferred embodiments of the present invention, the seam-engaging blades of the jaws each include a generally semi-cylindrical portion. When the actuator moves the first and second jaws toward the third, fourth and fifth jaws to the closed position, the semi-cylindrical portion of the seam-engaging blade of the first jaw passes at least partially between the semi-cylindrical portions of the seam-engaging blades of the third and fourth jaws. Likewise, the semi-cylindrical portion of the seam-engaging blade of the second jaw passes at least partially between the semi-cylindrical portions of the seam-engaging blades of the fourth and fifth jaws.

It is preferred that the semi-cylindrical portions of the first and second jaws extend about central axes that are coaxially aligned with each other. In other words, the central axis of the semi-cylindrical portion of the seam-engaging blade of the first jaw is coaxial with the central axis of the semi-cylindrical portion of the seam-engaging blade of the second jaw. Similarly, it is preferred that the semi-cylindrical portions associated with the third, fourth and fifth jaws extend about central axes that are coaxially aligned with each other. In addition, it is preferred that, when the jaws of the tool are compressed to the closed position, the central axes of the semi-cylindrical blade portions associated with the first and second jaws lie proximate to the central axes of the semi-cylindrical blade portions associated with the third, fourth and fifth jaws.

If desired, such semi-cylindrical blade portions may be provided upon detachable blade inserts of the type described above. As noted above, such detachable blade inserts may be coupled to their respective jaws by dovetail joints; each of such dovetail joints preferably extends generally perpendicular to the central axis of the generally semi-cylindrical blade portion coupled thereto. The detachable blade inserts may also be attached by mechanical fasteners, epoxy cement, solder, etc.

While the above-described embodiment of the invention using detachable blade inserts is described in conjunction with a five jaw tool, those skilled in the art will appreciate that it could also be used with a three jaw tool or a four jaw tool. In the case of a three jaw tool, the first jaw is associated with a first blade insert detachably coupled thereto for engaging a first wall of the seam. Second and third jaws are also provided, being spaced apart from each other, and generally facing the first jaw. Second and third detachable blade inserts are associated with the second and third jaws, respectively, and detachably coupled thereto for engaging the second opposing wall of the seam. As noted above, the detachable coupling is preferably achieved by using a dovetail joint.

An actuator is again provided to selectively move the first jaw relative to the second and third jaws, either moving the first jaw toward the second and third jaws into a closed position, or moving the first jaw away from the second and third jaws toward an opened position. The detachable blade insert coupled to the first jaw is initially spaced apart from the second and third jaws when the tool is in its opened position for insertion about the seam. Upon operating the actuator, the detachable blade insert coupled to the first jaw advances at least partially between the second and third blade inserts coupled to the second and third jaws. As before, the second and third detachable blade inserts form a die for receiving the first detachable blade insert. Also, as noted above, such detachable blade inserts may be tapered to be of slightly lesser widths at their peaks than at their bases to facilitate the release of the tool from the seam when the actuator of the tool is released. As also noted above, the first, second and third detachable blade inserts may be made of a "harder" steel than that used to make the first, second and third jaws. As also noted above, the detachable blade inserts may each include a generally semi-cylindrical portion extending therefrom.

DETAILED DESCRIPTION OF THE PREFERRED EMBODIMENT

Figure 1:
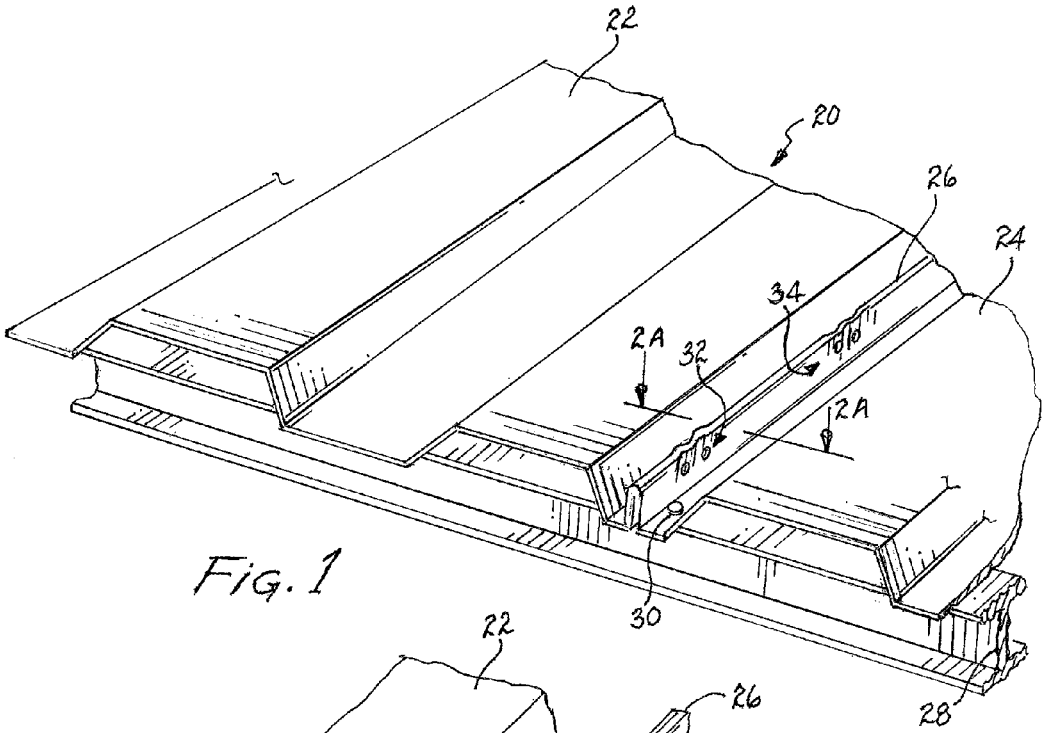
FIG. 1 is a perspective view of a steel roof deck including two ribbed steel deck panels having overlapped side edges forming a side-lapped deck seam.

Referring to FIG. 1, steel roof deck 20 is formed by attaching multiple roof deck panels, including ribbed panels 22 and 24. Such ribbed steel deck panels may be, for example, type B-deck panels available from Verco Decking Inc. of Phoenix, Ariz. The overlapped side edges of panels 22 and 24 form a seam 26. Steel roof deck 20 is supported by underlying steel beam 28, and is secured thereto, for example, by weld 30, though power-actuated fasteners (pins), screws, or rivets, may also be used. Side-lapped seam 26 is secured against longitudinal sliding movement by seam attachments 32 and 34.

Figure 2:
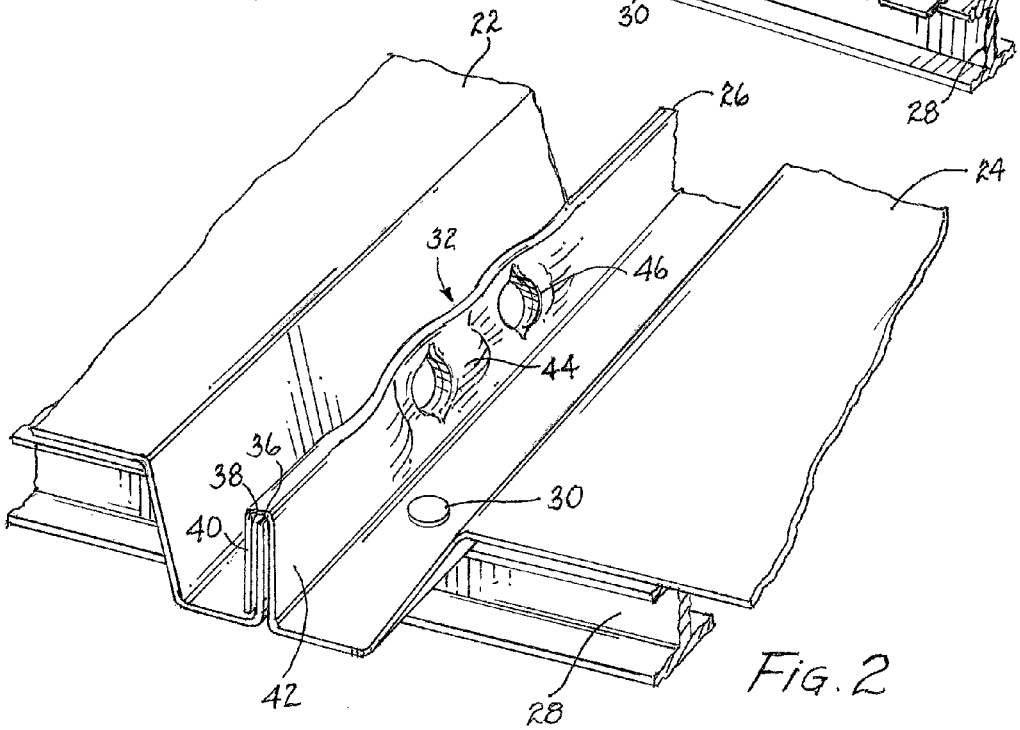
FIG. 2 is a detailed perspective view of a seam attachment formed in the deck seam by using a five jaw tool of the type described herein.

As shown best in the detailed view of FIG. 2, steel deck panel 22 includes an upturned lip 36 along one side edge thereof. Steel deck panel 24 includes a downwardly-directed U-shaped channel 38 along one of its side edges. Channel 38 of panel 24 is nested over, and receives, lip 36 of panel 22 to form deck seam 26. U-shaped channel 38 includes a first wall 40 on one side of seam 26 and a second wall 42 on the other side of seam 26. First wall 40 and second wall 42 extend generally parallel to each other, forming downwardly-directed channel 38, with lip 36 extending upwardly between first wall 40 and second wall 42.

Figure 2A:
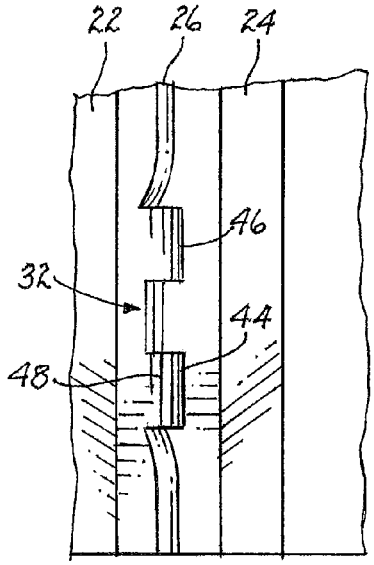
FIG. 2A is a sectional view of the side-lapped deck seam attachment shown in FIG. 2, taken through lines 2A-2A in FIG. 2.

Also shown in FIG. 2 is seam attachment point 32. Seam attachment point includes three deformed tabs, or louvers, two of which, 44 and 46, are clearly visible in FIG. 2. The third louver is disposed between louvers 44 and 46 and is deformed in the opposite direction. Turning briefly to FIG. 2A, the two louvers 44 and 46 are visible bowing outward to the right (relative to FIG. 2A), and a third louver 48 is visible bowing outward to the right (relative to FIG. 2A) directly between louvers 44 and 46.

Figure 3:
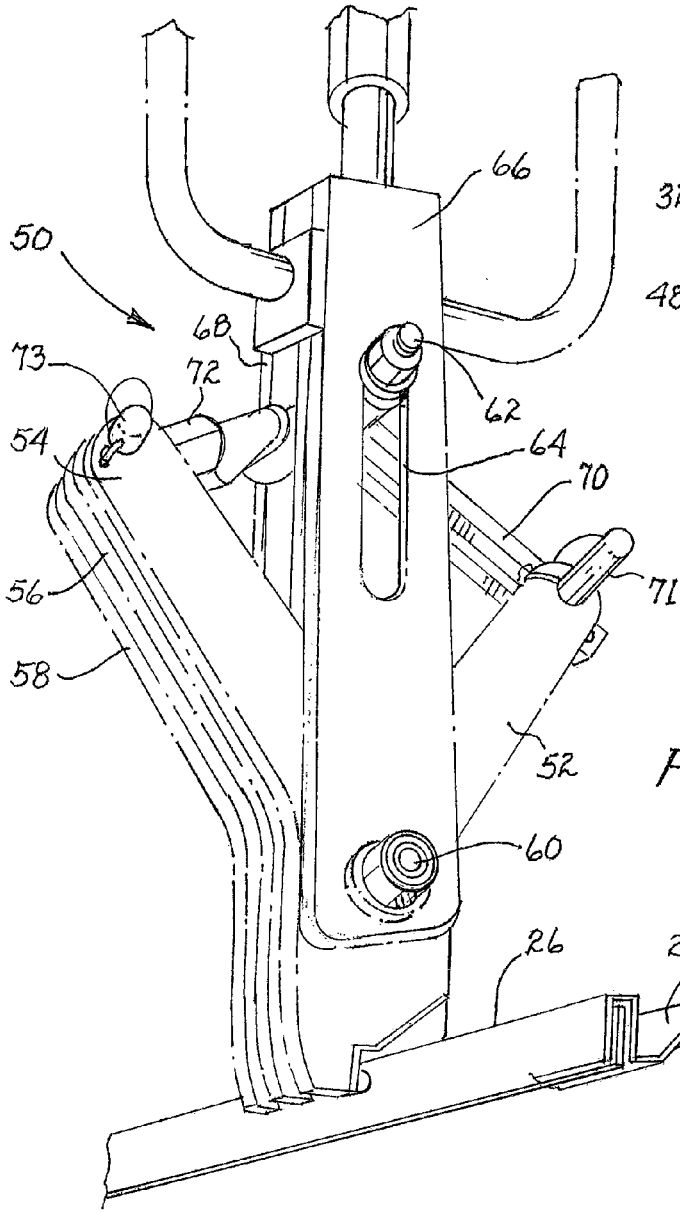
FIG. 3 is a perspective view of a five jaw punching tool being inserted over the side-lapped seam preliminary to forming the seam attachment.

In FIG. 3, the lower end of pneumatic punching tool 50 is shown. General details concerning the construction and operation of a pneumatic punching tool may be found in U.S. Pat. No. 5,878,617 to Parker, the contents of which is hereby incorporated by reference in its entirety. It should be sufficient to note that punching tool 50 includes two jaw members on one side thereof, including jaw member 52 and three jaw members on the other side, including jaw members 54, 56 and 58. Each of such jaw members is mounted for pivotal rotation about pivot axle 60, which extends through the lower end of punching tool 50. A pneumatic actuator (not shown in FIG. 3) reciprocates slide-action drive bolt 62 within slot 64 of fixed support brackets 66 and 68 of punching tool 50. Jaws 52-58 are preferably made from S-7 tool steel that is heat-treated to a hardness of 59-60 on the Rockwell "C" scale, and finished to a thickness of approximately 0.450-0.500 inch.

The upper ends of each jaw member are coupled by a link member to slide-action drive bolt 62. For example, the upper end of jaw member 52 is pivotally coupled by link 70 and pivot pin 71 to slide-action drive bolt 62, and the upper end of jaw member 54 is pivotally coupled by link 72 and pivot pin 73 to slide action drive bolt 62. As slide-action drive bolt 62 is forced downward within slot 64 toward pivot axle 60, links 70 and 72 cause the upper ends of jaw members 52-58 to rotate outwardly away from support brackets 24 and 26. This in turn causes the lower ends of jaw members 52-58 to pivot from their opened position to their closed position. Conversely, when slide-action drive bolt 62 is de-actuated, and pulled upwardly within slot 64 away from pivot axle 60, the lower ends of jaw members 52-58 open back up.

Once again, suitable apparatus for controlling and powering reciprocation of a slide-action drive bolt is disclosed generally in prior U.S. Pat. No. 5,878,617 to Parker. The pneumatic actuator of punch tool 50 typically operates with compressed air having a pressure ranging between 100-140 psi; this develops approximately 4,200 pounds of force on the lower ends of the jaws. Of course, the actuator used to reciprocate slide-action drive bolt 62 need not be hydraulic or pneumatic; for example, an electric motor could also be used to advance and retract slide-action drive bolt 62.

Figure 4:
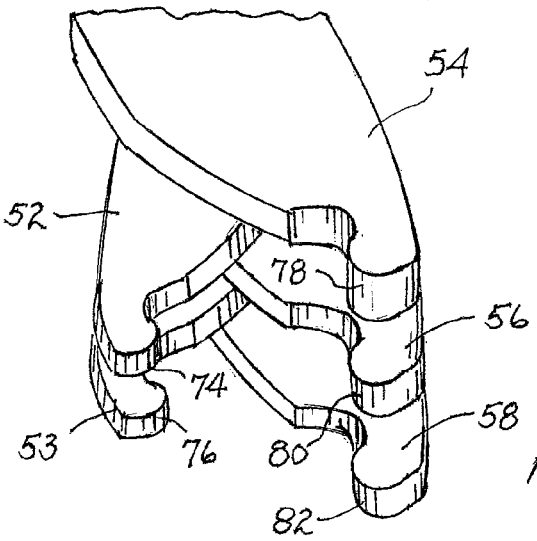
FIG. 4 is a detailed perspective view of a first embodiment of a five jaw punching tool wherein the cutting blades are integral with the jaws.
Figure 6:
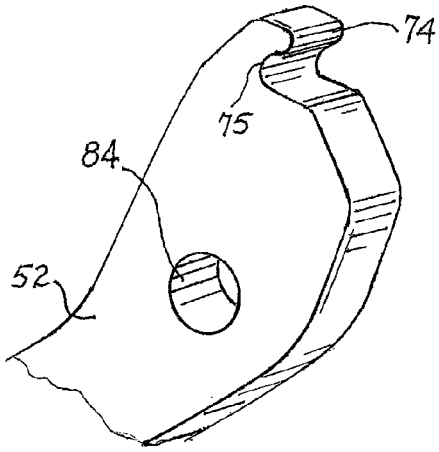
FIG. 6 is an enlarged perspective view of the working end of one of the jaws shown in FIG. 4.

FIG. 4 shows a first embodiment of the actual cutting blades provided at the lower working ends of jaws 52-58. First jaw 52 and second jaw 53 are spaced apart from each other. First jaw 52 terminates in a hooked blade 74, and second jaw 53 terminates in a hooked blade 76. A more detailed view of the lower end of jaw 52, and blade 74, is shown in FIG. 6, wherein bore 84 is provided to receive pivot axle 60. The hook-shaped terminal end of blade 74 bends through a rounded, generally semi-circular arc having a radius of approximately 0.15 inch. As shown best in FIG. 6, an undercut region 75 is inset from blade 74; undercut region 75 forms an arcuate curve about a radius of approximately 0.1875 inch. Second jaw 53 and its blade 76 are preferably formed in the same manner as first jaw 52 and its blade 74.

Blades 74 and 76 are adapted to simultaneously engage a first wall of the U-shaped channel at deck seam 26. Third jaw 54 includes a rounded blade 78 at its lower end; fourth jaw 56 includes a rounded blade 80 at its lower end; and fifth jaw 58 likewise includes a rounded blade 82 at its lower end. The third, fourth and fifth jaws (54, 56, and 58) are spaced apart from each other, and generally face the first and second jaws (52 and 53). Blades 78, 80 and 82 are adapted to simultaneously engage the second wall of the U-shaped channel at deck seam 26. Preferably, blades 78, 80 and 82 are formed in the same manner as blades 74 and 76.

As illustrated in FIG. 4, blades 74, 76, 78, 80 and 82 are in the opened position for allowing the respective jaws to be placed over and around deck seam 26. When the actuator of punching tool 50 is triggered, punching tool 50 selectively moves blades 52, 53, 78, 80 and 82 toward each other and into a closed position. When the actuator is later released, punching tool 50 moves blades 52, 53, 78, 80 and 82 away from each other and back to the opened position shown in FIG. 4.

Figure 10:
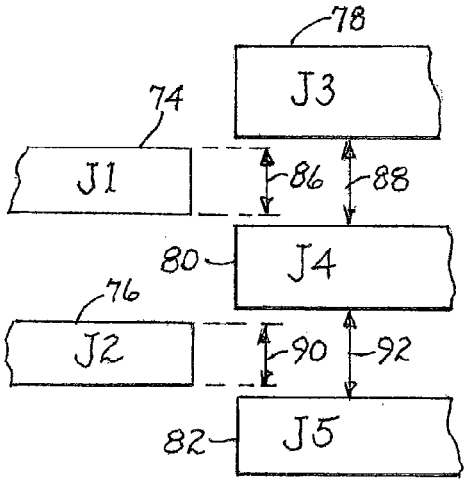
FIG. 10 is a schematic view of a five jaw tool in its opened position, i.e., wherein the first and second jaws are spaced apart from the third, fourth and fifth jaws.
Figure 11:
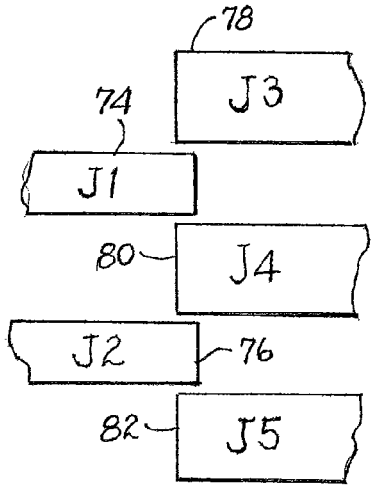
FIG. 11 is a schematic view of the five jaw tool of FIG. 10, but shown in its closed position, i.e., wherein the first jaw advances at least partially between the third and fourth jaws, and wherein the second jaw advances at least partially between the fourth and fifth jaws.

Turning briefly to the schematic of FIG. 10, the opened position of the jaws is shown. Blade 74 of the first jaw, and blade 76 of the second jaw, are spaced apart from blades 78, 80, and 82 of the third, fourth, and fifth jaws, respectively. In the schematic of FIG. 11, the closed position of the jaws is shown. In the closed position, blade 74 of first jaw 52 has passed at least partially between blades 78 and 80 of third and fourth jaws 54 and 56, respectively. Likewise, in the closed position of FIG. 11, blade 76 of second jaw 53 has passed at least partially between blades 80 and 82 of fourth and fifth jaws 56 and 58, respectively.

Referring again to the schematic drawing of FIG. 10, blade 74 of first jaw 52 has a width (W1) designated by arrow 86. Blades 78 and 80 of third and fourth jaws 54 and 56 are spaced apart from each other by a spacing (S1) designated by arrow 88. Preferably, width 86 (W1) and spacing 88 (S1) are substantially equal to each other. In this manner, blades 78 and 80 provide a die that receives blade 74. Similarly, blade 76 of second jaw 53 has a width (W2) designated by arrow 90. Blades 80 and 82 of fourth and fifth jaws 56 and 58 are spaced apart from each other by a spacing (S2) designated by arrow 92. Preferably, width 90 (W2) and spacing 92 (S2) are substantially equal to each other. In this manner, blades 80 and 82 provide a die that receives blade 76.

Figure 12:
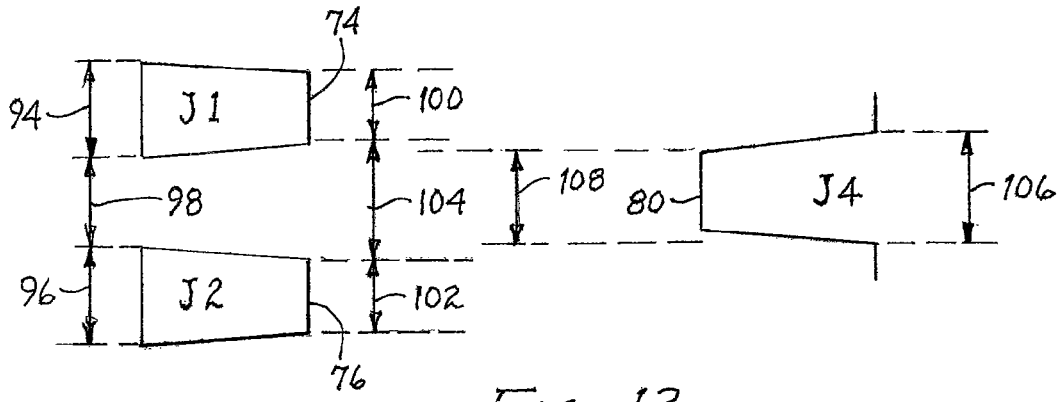
FIG. 12 is another schematic view of the five jaw tool of FIG. 10, but including only the first, second and fourth jaws.

In a similar manner, blades 74 and 76 of first and second jaws 52 and 53 provide a die that receives blade 80 of fourth jaw 56. Turning to FIG. 12, blades 74 and 76 of first and second jaws 52 and 53 are shown as having a taper, whereby blades 74 and 76 each have a width that varies slightly. Near the base region of such blades, blade 74 has a width designated by arrow 94, blade 76 has a width designated by arrow 96, and blades 74 and 76 are spaced apart from each other by a distance (D1) designated by arrow 98. However, at the tips, or peak regions, of such blades, blade 74 has a width designated by arrow 100, blade 76 has a width designated by arrow 102, and blades 74 and 76 are spaced apart from each other by a distance (D2) designated by arrow 104. Preferably, distance 104 (D2) exceeds distance 98 (D1) to facilitate the release of blades 74 and 76 of first and second jaws 52 and 53 from the deck seam when the actuator of punching tool 50 is released.

Still referring to FIG. 12, as was noted above, blade 74 of first jaw 52 has a width 94 (W1) near its base region, and a width 100 (W2) near its peak region. Similarly, blade 76 of second jaw 53 has a width 96 (W1) near its base region, and a width 102 (W2) near its peak region. It has been found that making width W2 at least 0.005 inch smaller than width W1 will facilitate the release of blades 74 and 76 from the deck seam. Blade 80 of fourth jaw 58 likewise has a slightly greater width 106 at its base region than its width 108 near its peak region, the difference preferably being at least 0.005 inch to facilitate the release of blade 80 from the deck seam. In any event, distance 104, separating blades 74 and 76 near their peak regions, is slightly greater than width 108, for allowing the peak region of blade 80 to advance into blades 74 and 76 when punching tool 50 is actuated.

Figure 5:
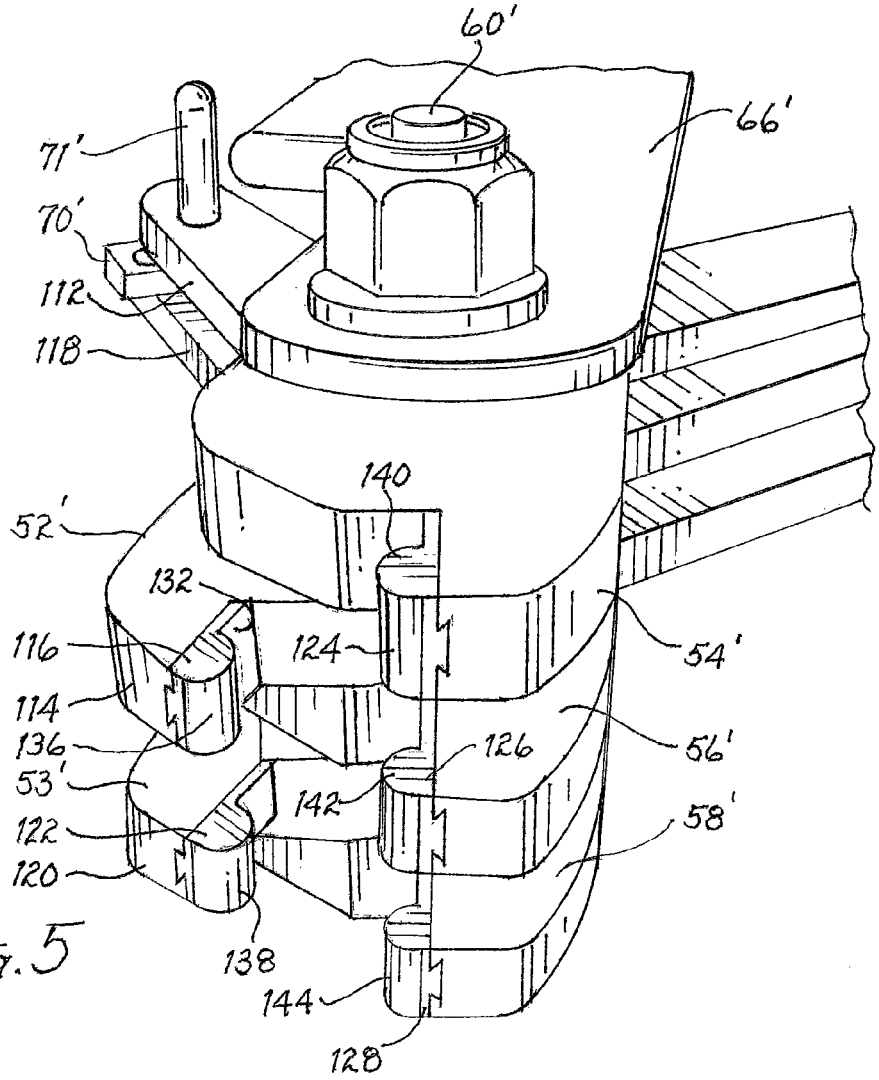
FIG. 5 is a detailed perspective view of a second embodiment of a five jaw punching tool wherein all five jaws include detachable blade inserts.

Now turning to FIG. 5, an alternate embodiment of the present invention is illustrated wherein features corresponding to those already described above relative to FIG. 4 are designated by like primed reference numerals. First jaw 52' includes an upper end 112 and a lower end 114. Coupled to lower end 114 of first jaw 52' is a detachable blade insert 116 for engaging the deck seam when punching tool 50 is actuated to the closed position. Likewise, second jaw 53' includes an upper end 118 and a lower end 120. Coupled to lower end 120 of second jaw 53' is detachable blade insert 122 for engaging the deck seam when punching tool 50 is actuated to the closed position. Similar detachable blade inserts 124, 126, and 128 are coupled to the lower ends of jaws 54', 56' and 58', respectively.

As noted earlier, one of the advantages of using detachable blade inserts is that they can be formed of material that is relatively harder than the material from which the jaw itself is formed. For example, blade inserts 116-128 are preferably made from S-7 tool steel that is heat treated to be fully hardened to within the range of 56-58 on the Rockwell "C" scale. On the other hand, jaws 52'-58' may be formed from AISI Grade 4140, or Grade 4340, tool steel hardened to within the range of 45-48 on the Rockwell "C" scale. This allows the blades themselves to be relatively hard for shearing the deck seam, while allowing the jaws themselves to be made of a more elastic material that is not as brittle and less likely to break under repeated actuation cycles.

Of course, the other primary advantage of using such detachable blade inserts relates to ease of repair if one or more of such blade inserts should break during use. It is not necessary to disassemble jaws 52-58 from pivot axle 60' of punching tool 50 if one or more of the detachable blade inserts should break. Rather, the broken blade insert need only be removed from its corresponding jaw, and replaced with a fresh blade insert. Likewise, if it is noticed, during routine maintenance of such tools, that one or more blade inserts are excessively worn, the worn blade inserts can easily be removed and replaced with fresh blade inserts before putting the tool back in the field, all without requiring disassembly of the tool.

Figure 7:
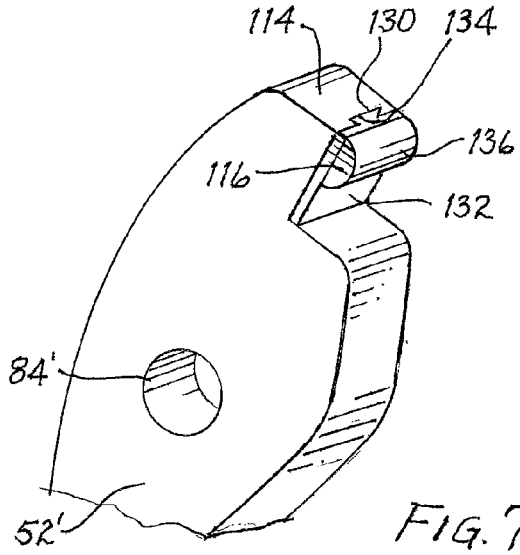
FIG. 7 is an enlarged perspective view of the working end of one of the jaws shown in FIG. 5, including a detachable blade insert coupled to its jaw by a dovetail joint, and wherein the detachable blade insert includes a semi-cylindrical portion

As shown in FIGS. 5 and 7, each detachable blade insert is preferably coupled to the lower end of its corresponding jaw by a sliding dovetail joint. As shown in FIG. 7, lower end 114 of jaw 52' includes a flattened plateau, or base region, into which a trapezoidal-shaped channel 130 is formed; channel 130 extends generally toward pivot bore 84' and preferably extends along an axis that is generally perpendicular to the central axis of bore 84', and hence, generally perpendicular to pivot axle 60'. Trapezoidal channel 130 is wider at the bottom of such channel than it is when it reaches the flattened plateau.

Figure 8:
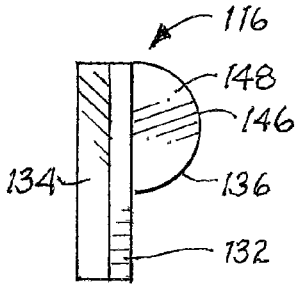
FIG. 8 is an end view of the detachable blade insert shown in FIG. 7.
Figure 9:
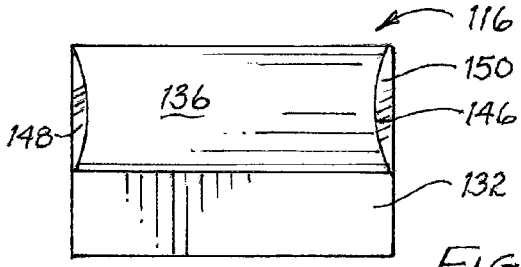
FIG. 9 is a top view of the detachable blade insert shown in FIG. 7.

Referring to FIGS. 7,8 and 9, detachable blade insert 116 includes an essentially planar base region 132, the underside of which is supported by the flattened plateau formed upon jaw 52'. Extending from the underside of base region 132 is a trapezoidal-shaped rib 134 that slidingly mates with channel 130 of jaw 52'. Preferably, blade insert is retained upon jaw 52' by maintaining tight tolerances while machining channel 130 and machining mating rib 134. Alternate methods of ensuring that rib 134 of blade insert 116 does not inadvertently slide out of channel 130 of jaw 52' include the use of mechanical fasteners or the application of an epoxy cement or heated solder to the dovetail joint.

Those skilled in the art will appreciate that, while such detachable blade inserts have been described above in conjunction with a five jaw punching tool, such detachable blade inserts can provide significant advantages even when used with earlier three-jaw or four-jaw punching tools.

Still referring to FIGS. 7-9, detachable blade insert 116 includes a generally semi-cylindrical portion 136 projecting outwardly from base region 132. Referring briefly to FIG. 5, the other four blade inserts 122-128 also include generally semi-cylindrical portions 138, 140, 142, and 144, respectively. When punching tool 50 is actuated, semi-cylindrical portion 136 of blade insert 116 of first jaw 52' passes at least partially between the semi-cylindrical portions 140 and 142 of blade inserts 124 and 126 of the third and fourth jaws 54' and 56'. Likewise, when punching tool 50 is actuated, semi-cylindrical portion 138 of blade insert 122 of second jaw 53' passes at least partially between the semi-cylindrical portions 142 and 144 of blade inserts 126 and 128 of fourth and fifth jaws 56' and 58'. As shown best in FIGS. 7 and 8, generally semi-cylindrical portion 136 of blade insert 116 extends along an axis that is generally perpendicular to the central axis of the dovetail joint formed by channel 130 and rib 134. Though not required, the use of such generally semi-cylindrical portions on the blade inserts seems to help create louvers formed in the deck seam in a preferred manner.

Though not required, it is preferred that the central axes about which semi-cylindrical portions 136 and 138 extend be coaxial with each other. It is also preferred, though not required, that the central axes about which semi-cylindrical portions 140, 142 and 144 extend also be coaxial with each other. In this preferred scenario, when punching tool 50 is actuated to advance the jaws to the closed position, the central axes of semi-cylindrical portions 136 and 138, and the central axes of semi-cylindrical portions 140, 142, and 144, lie generally proximate to each other.

Referring to FIGS. 8 and 9, generally semi-cylindrical portion 136 rises from base region 132 to a peak 146. The width (W1) of generally semi-cylindrical portion 136 at the opposing ends of base region 132 is preferably greater than the width (W2) of generally semi-cylindrical portion 136 at the opposing ends of peak 146. In FIG. 9, the tapering of the ends of generally semi-cylindrical portion 136 is shown in exaggerated form by angled surfaces 148 and 150. In actuality, width W2 is preferably made at least 0.005 inch smaller than width W1 to facilitate the release of first jaw 52' from the deck seam after punching tool 50 is released. The other four blade inserts 138-144 are preferably formed in a similar fashion.

Figure 13:
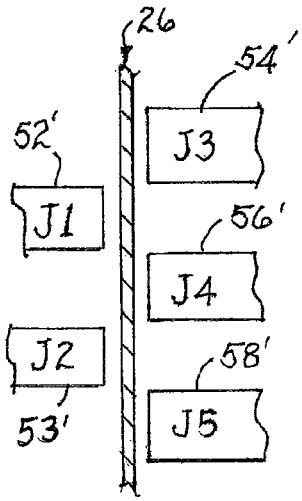
FIG. 13 is a further schematic view of the five jaw tool illustrating the orientation of the five jaws relative to the deck seam before the actuator of the tool is triggered.
Figure 14:
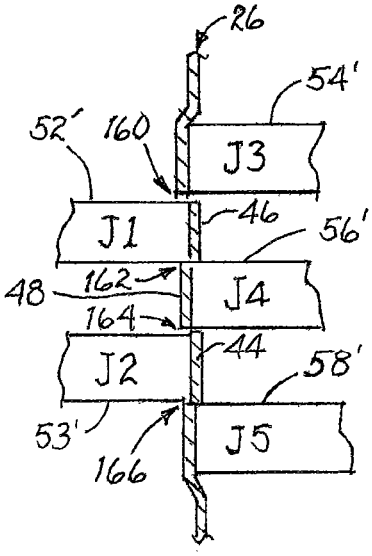
FIG. 14 is a schematic view similar to FIG. 13 but illustrating the orientation of the five jaws relative to the deck seam just after the actuator of the tool is triggered.
Figure 15:
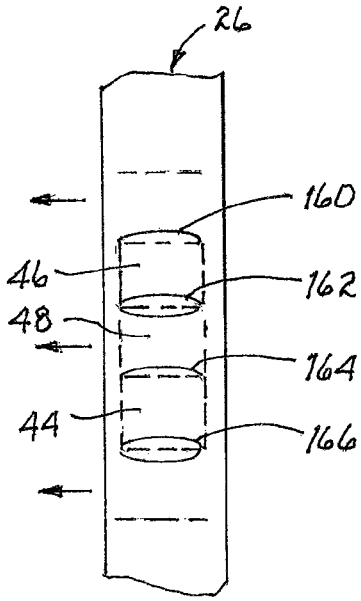
FIG. 15 is a simplified schematic view of three louvers formed in the deck seam after the actuator of the punching tool is triggered.

Turning now to FIGS. 13-15, FIG. 13 shows in schematic form the lower ends of jaws 52', 53', 54', 56' and 58', oriented as they would be when punching tool 50 is inserted over deck seam 26, and before punching tool 50 is actuated. FIG. 14 shows in schematic form the lower ends of jaws 52', 53', 54', 56' and 58', oriented as they would be just after punching tool 50 is actuated. First jaw 52' and third jaw 54' together shear a first cut line 160 in deck seam 26. First jaw 52' and fourth jaw 56' together shear a second cut line 162 parallel to, and spaced apart from, first cut line 160. Similarly, second jaw 53' cooperates with fourth and fifth jaws 56' and 58' to shear third and fourth cut lines 164 and 166, respectively, and parallel to cut lines 160 and 162. The resulting punched deck seam is shown schematically in FIG. 15. Louver 44 bows upwardly (toward the viewer of FIG. 15) between cut lines 164 and 166. Louver 48 bows downwardly (away from the viewer of FIG. 15) between cut lines 162 and 164. Louver 46 bows upwardly (toward the viewer of FIG. 15) between cut lines 160 and 162. The resulting deck seam attachment is very secure, and very resistant to sliding relative motion between the two joined deck panels along the axis of such seam.

Those skilled in the art will now appreciate that a punching tool for forming an attachment in an interlocking side-lapped seam of metal decking has been described which provides a reliable attachment with improved resistance to horizontal shear forces exerted along the length of the deck seam. A punching tool provided with jaws of the type described herein can be easily operated by a deck installer to form such attachments along the deck seam relatively quickly. The resulting seam attachments can easily be inspected by someone standing atop the assembled steel decking. By providing five jaws, the wear on the various jaws is better equalized for longer life. Moreover, by using the detachable blade inserts described above, any blades which do break can be repaired quickly and easily without requiring disassembly of all of the jaws from the punching tool. In addition, the disclosed jaws are less likely to bind in the deck seam after the punching tool is actuated and then released. The orientation of the jaws is entirely symmetrical, and no twisting torque force is produced upon actuation of the tool.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A punching tool for forming an attachment in an interlocking side-lapped seam of a steel deck structure, the steel deck structure including at least first and second steel deck panels, the first steel deck panel including an upturned lip along one side edge thereof, the second steel deck panel including a downwardly-directed generally U-shaped channel along one side edge thereof for receiving the upturned lip of the first steel deck panel, the U-shaped channel including first and second walls generally parallel to each other, the punching tool comprising:

a. first and second jaws spaced apart from each other, each of said first and second jaws having a seam-engaging blade for engaging the first wall of the U-shaped channel;

b. third, fourth and fifth jaws spaced apart from each other, the third, fourth and fifth jaws generally facing the first and second jaws, each of said third, fourth and fifth jaws having a seam-engaging blade for engaging the second wall of the U-shaped channel;

c. an actuator for selectively moving the first and second jaws relative to the third, fourth and fifth jaws, said actuator being adapted to move the first and second jaws toward the third, fourth and fifth jaws to a closed position, and being adapted to move the first and second jaws away from the third, fourth and fifth jaws to an opened position;

d. the first jaw being movable between the opened position spaced from the third and fourth jaws, and the closed position in which the seam-engaging blade of the first jaw passes at least partially between the seam-engaging blades of the third and fourth jaws; and e. the second jaw being movable between the opened position spaced from the fourth and fifth jaws, and the closed position in which the seam-engaging blade of the second jaw passes at least partially between the seam-engaging blades of the fourth and fifth jaws.

2. The punching tool recited by claim 1 wherein the seam engaging blade of the first jaw has a width W1, and wherein the seam-engaging blades of the third and fourth jaws are spaced apart from each other by a spacing S1, and wherein width W1 and spacing S1 are substantially equal to each other.

3. The punching tool recited by claim 2 wherein the seam-engaging blade of the second jaw has a width W2, and wherein the seam-engaging blades of the fourth and fifth jaws are spaced apart from each other by a spacing S2, and wherein width W2 and spacing S2 are substantially equal to each other.

4. The punching tool recited by claim 1 wherein:

a. the seam-engaging blade of the first jaw includes a base region and a peak region, the peak region projecting beyond the base region; and b. the seam-engaging blade of the second jaw includes a base region and a peak region, the peak region projecting beyond the base region.

5. The punching tool recited by claim 4 wherein:

a. the base region of the first jaw is spaced apart from the base region of the second jaw by a distance D1;

b. the peak region of the first jaw is spaced apart from the peak region of the second jaw by a distance D2; and c. distance D2 exceeds distance D1 to facilitate the release of the seam engaging blades of the first and second jaws from the side-lapped seam of the steel deck structure.

6. The punching tool recited by claim 4 wherein:

a. the seam-engaging blade of the first jaw has a width W1 adjacent the base region thereof;

b. the seam-engaging blade of the second jaw has width W1 adjacent the base region thereof;

c. the seam-engaging blade of the first jaw has a width W2 adjacent the peak region thereof;

d. the seam-engaging blade of the second jaw has width W2 adjacent the peak region thereof; and e. width W2 is at least 0.005 inch smaller than width W1 to facilitate the release of the seam engaging blades of the first and second jaws from the side-lapped seam of the steel deck structure.

7. The punching tool recited by claim 1 wherein:

a. the seam-engaging blade of the first jaw includes a first insert, detachable from the first jaw, for engaging the side-lapped seam of the steel deck structure when the first and second jaws are moved to the closed position; and b. the seam-engaging blade of the second jaw includes a second insert, detachable from the second jaw, for engaging the side-lapped seam of the steel deck structure when the first and second jaws are moved to the closed position.

8. The punching tool recited by claim 7 wherein the first and second jaws are made of a metal having a first hardness rating on the Rockwell C scale, and wherein the first and second detachable inserts are made of a metal having a second hardness rating on the Rockwell C scale higher than said first hardness rating.

9. The punching tool recited by claim 7 wherein the first detachable insert is removably secured to the first jaw by a dovetail joint.

10. The punching tool recited by claim 9 wherein the second detachable insert is removably secured to the second jaw by a dovetail joint.

11. The punching tool recited by claim 1 wherein:

a. the seam-engaging blades of the first and second jaws each includes a generally semi-cylindrical portion;

b. the seam-engaging blades of the third, fourth and fifth jaws each include a generally semi-cylindrical portion;

c. the semi-cylindrical portion of the seam-engaging blade of the first jaw passing at least partially between the semi-cylindrical portions of the seam-engaging blades of the third and fourth jaws when the actuator moves the jaws to the closed position; and d. the semi-cylindrical portion of the seam-engaging blade of the second jaw passing at least partially between the semi-cylindrical portions of the seam-engaging blades of the fourth and fifth jaws when the actuator moves the jaws to the closed position.

12. The punching tool recited by claim 11 wherein each of the generally semi-cylindrical portions of the seam-engaging blades of the first and second jaws extends about a central axis, the central axis of the generally semi-cylindrical portion of the seam-engaging blade of the first jaw being coaxial with the central axis of the generally semi-cylindrical portion of the seam-engaging blade of the second jaw.

13. The punching tool recited by claim 12 wherein each of the generally semi-cylindrical portions of the seam-engaging blades of the third, fourth and fifth jaws extends about a central axis, the central axes of the generally semi-cylindrical portions of the seam-engaging blades of the third, fourth, and fifth jaws being coaxial with each other.

14. The punching tool recited by claim 13 wherein the central axes of the semi-cylindrical portions of the seam-engaging blades of the first and second jaws, and the central axes of the semi-cylindrical portions of the seam-engaging blades of the third, fourth and fifth jaws, lie generally proximate to each other when the actuator moves the jaws to the closed position.

15. The punching tool recited by claim 11 wherein each of the generally semi-cylindrical portions of the seam-engaging blades of the first and second jaws is detachably coupled to its respective jaw.

16. The punching tool recited by claim 15 wherein each of the generally semi-cylindrical portions detachably coupled to the first and second jaws is coupled thereto by a dovetail joint.

17. The punching tool recited by claim 16 wherein:

a) the first and second jaws are rotatably mounted about an axle; and b) each such dovetail joint extends along an axis that is oriented generally perpendicular to said axle.

18. The punching tool recited by claim 16 wherein:

a) each of the generally semi-cylindrical portions of the seam-engaging blades extends about a central axis; and b) each of the dovetail joints securing the generally semi-cylindrical portions of the seam-engaging blades to the first and second jaws extends generally perpendicular to the central axes of the generally semi-cylindrical portions of the seam-engaging blades.

19. A punching tool for forming an attachment in an interlocking side-lapped seam of a steel deck structure, the steel deck structure including at least first and second steel deck panels, the first steel deck panel including an upturned lip along one side edge thereof, the second steel deck panel including a downwardly-directed generally U-shaped channel along one side edge thereof for receiving the upturned lip of the first steel deck panel, the U-shaped channel including first and second walls generally parallel to each other, the punching tool comprising:

a. a first jaw;

b. a first blade insert detachably coupled to the first jaw for engaging the first wall of the U-shaped channel;

c. second and third jaws spaced apart from each other, the second and third jaws generally facing the first jaw;

d. second and third blade inserts detachably coupled to the second and third jaws, respectively, for engaging the second wall of the U-shaped channel;

e. an actuator for selectively moving the first jaw relative to the second and third jaws, said actuator being adapted to move the first jaw toward the second and third jaws into a closed position, and being adapted to move the first jaw away from the second and third jaws toward an opened position;

f. the first blade insert being movable between the opened position spaced from the second and third blade inserts, and the closed position in which the first blade insert passes at least partially between the second and third blade inserts; and g. wherein the first blade insert includes a first base, and wherein at least a portion of the first blade insert projects from the first base to a first peak, and wherein:

i) the first blade insert has a width W1 adjacent the first base;

ii) the first blade insert has a width W2 adjacent the first peak; and iii) width W2 is at least 0.005 inch smaller than width W1 to facilitate the release of the first jaw from the second and third jaws following formation of a seam attachment in the side-lapped seam of the steel deck structure.

20. The punching tool recited by claim 19 wherein:

a. the second blade insert includes a second base, and wherein at least a portion of the second blade insert projects from the second base to a second peak; and b. the third blade insert includes a third base, and wherein at least a portion of the third blade insert projects from the third base to a third peak.

21. The punching tool recited by claim 20 wherein:

a. the second and third blade inserts each have a width W3 adjacent the second and third bases, respectively;

b. the second and third blade inserts have a width W4 adjacent the second and third peaks, respectively; and c. width W4 is at least 0.005 inch smaller than width W3 to facilitate the release of the first jaw from the second and third jaws following formation of a seam attachment in the side-lapped seam of the steel deck structure.

22. The punching tool recited by claim 21 wherein width W3 is equal to width W1, and wherein width W4 is equal to width W2.

23. The punching tool recited by claim 19 wherein the first, second, and third jaws are made of a metal having a first hardness rating on the Rockwell C scale, and wherein the first, second and third blade inserts are made of a metal having a second hardness rating on the Rockwell C scale higher than said first hardness rating.

24. The punching tool recited by claim 19 wherein:

a. the first blade insert is removably coupled to the first jaw by a first dovetail joint;

b. the second blade insert is removably coupled to the second jaw by a second dovetail joint; and c. the third blade insert is removably coupled to the third jaw by a third dovetail joint.

25. The punching tool recited by claim 19 wherein:

a. the first blade insert includes a generally semi-cylindrical portion extending therefrom;

b. the second blade insert includes a generally semi-cylindrical portion extending therefrom;

c. the third blade insert includes a generally semi-cylindrical portion extending therefrom;

d. the semi-cylindrical portion of the first blade insert passes at least partially between the semi-cylindrical portions of the second and third blade inserts when the actuator moves the first jaw toward the second and third jaws into the closed position.

26. The punching tool recited by claim 25 wherein:

a) the generally semi-cylindrical portion of the second blade insert extends about a central axis;

b) the generally semi-cylindrical portion of the third blade insert extends about a central axis; and c) the central axes of the generally semi-cylindrical portions of the second and third blade inserts are coaxial with each other.

27. The punching tool recited by claim 26 wherein:

a) the generally semi-cylindrical portion on the first blade insert extends about a central axis; and b) the central axis of the semi-cylindrical portion of the first blade insert lies generally proximate to the central axes of the semi-cylindrical portions of the second and third blade inserts when the actuator moves the first jaw toward the second and third jaws into the closed position.

28. The punching tool recited by claim 25 wherein each of the first, second and third blade inserts is detachably coupled to its respective jaw by a dovetail joint.

29. The punching tool recited by claim 28 wherein:

a) the first, second and third jaws are rotatably mounted about an axle; and b) each such dovetail joint extends along an axis that is oriented generally perpendicular to said axle.

30. The punching tool recited by claim 28 wherein:

a) each generally semi-cylindrical portion of each blade insert extends about a central axis; and b) each of the dovetail joints coupling the first, second and third blade inserts to the first, second and third jaws, respectively, extends generally perpendicular to the central axis of its respective semi-cylindrical portion.

* * * * *